US006463255B1

(12) United States Patent
Shultz

(10) Patent No.: US 6,463,255 B1
(45) Date of Patent: Oct. 8, 2002

(54) SHEET FEEDER, IMAGING SYSTEM AND METHOD

(75) Inventor: Brian Shultz, Oceanside, CA (US)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/722,442

(22) Filed: Nov. 28, 2000

(51) Int. Cl.[7] ..... G03G 15/00
(52) U.S. Cl. ..... 399/393; 271/117
(58) Field of Search ..... 271/117, 118, 271/145, 147; 399/393

(56) References Cited

U.S. PATENT DOCUMENTS 5,377,969 A * 1/1995 Steinhilber ..... 271/114
6,254,080 B1 * 7/2001 Bass ..... 271/10.11
6,318,715 B1 * 11/2001 Froechte et al. ..... 271/117
6,322,065 B1 * 11/2001 Underwood et al. ..... 271/117

* cited by examiner

*Primary Examiner*—Robert Beatty

(57) ABSTRACT

An imaging subsystem for forming an image on a sheet comprises a tray for holding a supply of sheets, a ramp for directing a sheet from the tray to the imaging subsystem and a drive assembly including a roller for moving a top sheet of the supply of sheets in the tray to the ramp with a reciprocating roller stroke. The drive assembly is configured to maintain a constant roller stroke distance between the roller and the ramp. A sheet feeder comprises a linkage and a roller disposed on the linkage for contacting and driving a sheet from a supply of sheet material by a reciprocal linear movement through a roller stroke distance. The linkage is configured to maintain a constant roller stroke distance between the roller and the ramp. In a method, a roller is moved in a reciprocating stroke to drive a sheet from a supply of sheets to a ramp that directs the sheet to an imaging subsystem. A constant distance is maintained for each stroke as the supply of sheets diminishes.

39 Claims, 3 Drawing Sheets

FIG. 5
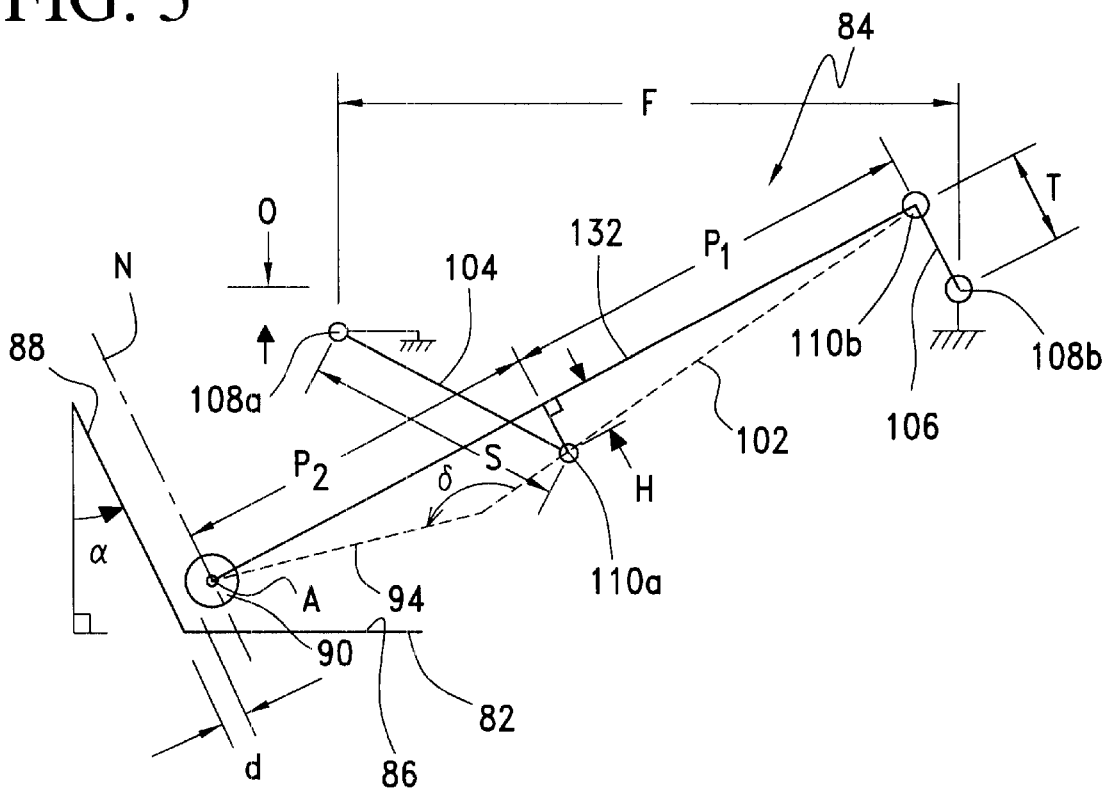
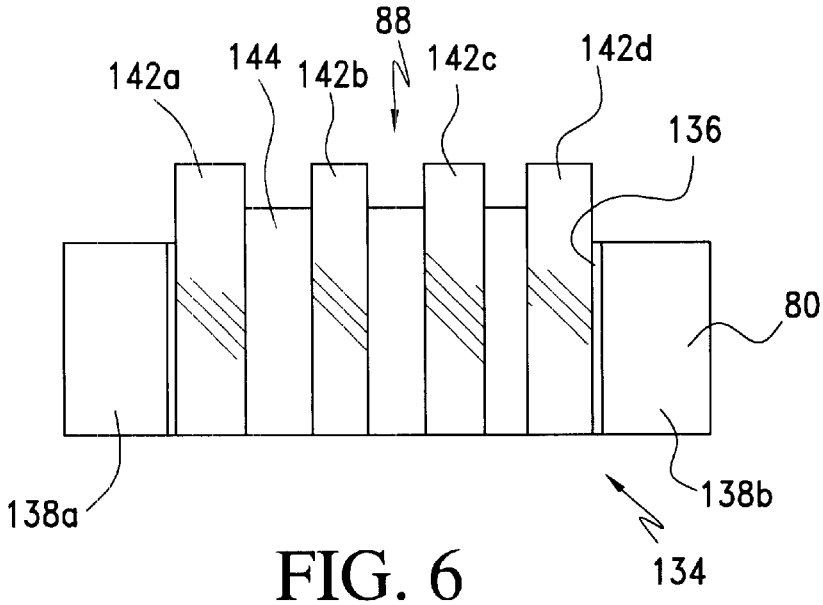
FIG. 6

SHEET FEEDER, IMAGING SYSTEM AND METHOD

BACKGROUND OF THE INVENTION

The invention relates to a sheet feeder, imaging system incorporating the sheet feeder and a method. More particularly, the invention relates to a sheet feeder with a link member that maintains a constant stroke distance between a paper-engaging roller and an inclined paper ramp. The sheet feeder is particularly advantageous when incorporated into an imaging system, such as a printer or photocopier.

A quality imaging system requires consistent and error-free feeding of paper from a paper tray. A sheet of paper can become jammed immediately upon exiting the paper tray or at some location downstream in the paper path. Other times two or more pieces of paper are fed simultaneously from the paper tray to cause a jam or other misfunction. A great deal of effort is directed to providing paper imaging system features to avoid jamming or misfunction to overcome these problems.

One approach to reducing paper-feed error involves mounting a sheet-separating roller in a freely movable manner in a plane parallel to the stack of paper sheets. The roller moves as a function of the stiffness of the sheets. For example if a top sheet has a high stiffness, then the roller will move rearward until the front edge of the sheet is bent and urged up a receiving ramp. One of the drawbacks of such an approach is the relatively large number of parts required to move a roller proportionally to the stiffness of the sheet.

In view of the foregoing, there is a need for a sheet feeder, imaging system and method to feed paper sheets in a consistent and substantially error-free manner.

BRIEF SUMMARY OF THE INVENTION

The invention relates to a sheet feeder, imaging system and method that provide paper feed in a consistent and substantially error-free manner. In one embodiment, the invention is an imaging subsystem for forming an image on a sheet. The subsystem comprises a tray for holding a supply of sheets, a ramp for directing a sheet from the tray to the imaging subsystem and a drive assembly including a roller for moving a top sheet of the supply of sheets in the tray to the ramp with a reciprocating roller stroke. The drive assembly is configured to maintain a constant roller stroke distance between the roller and the ramp.

In another embodiment, the invention relates to a sheet feeder for an imaging system, the sheet feeder comprising a linkage and a roller disposed on the linkage for contacting and driving a sheet from a supply of sheet material by a reciprocal linear movement through a roller stroke distance. The linkage is configured to maintain a constant roller stroke distance between the roller and the ramp.

Finally in an embodiment, the invention is a method for feeding sheets in an imaging system. In the method, a roller is moved in a reciprocating stroke to drive a sheet from a supply of sheets to a ramp that directs the sheet to an imaging subsystem. A constant distance is maintain ed for each stroke as the supply of sheets diminishes.

BRIEF DESCRIPTION OF THE DRAWINGS

FIG. 5 is a schematic view illustrating dimensions of an exemplary embodiment of a linkage of the present invention; and FIG. 6 is an elevational view of an exemplary configuration of a front of a supply tray in relation to a ramp of the present invention.

DETAILED DESCRIPTION OF THE INVENTION

Figure 1:
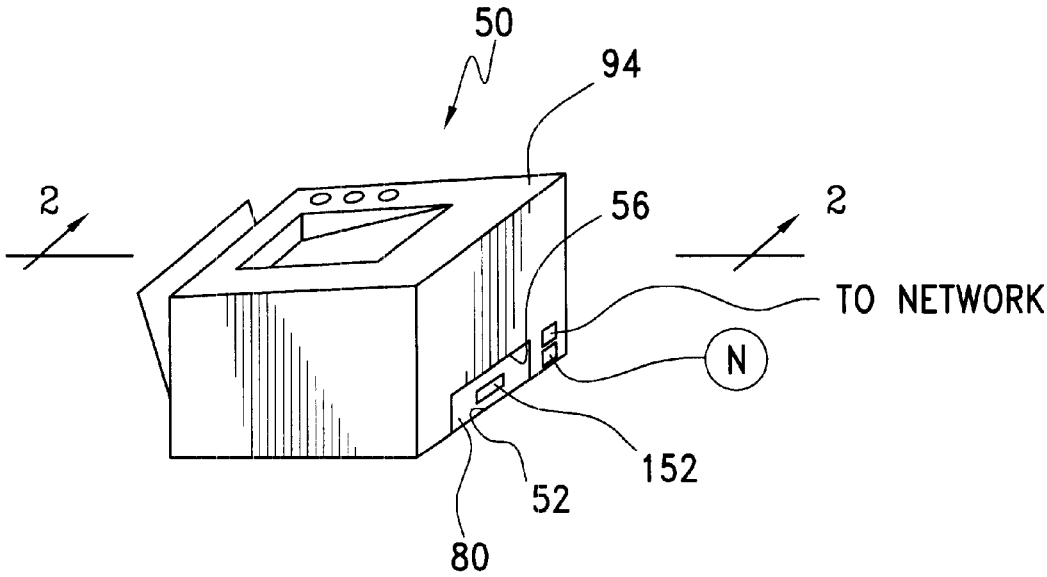
FIG. 1 is a perspective view of an imaging system configured in accordance with the principles of the present invention.

According to the invention, a constant roller stroke distance is maintained between a sheet-feeding roller and a ramp for directing the sheets out of a supply tray. This constant roller stroke distance is maintained regardless of the level of sheet material (e.g., paper) in the supply tray. The principles of the present invention may be applied to imaging systems of all types, such as printers, photocopiers, facsimile machines and so on.

In a preferred embodiment, the imaging system is a printer, such as a color laser printer, and the imaging subsystem forms images according to electrophotographic (EPG) principles. The sheet material held in the tray may be paper, transparencies, label sheets, cards, envelopes, and so on. Preferably, the ramp includes one or more low-friction members that provide a smooth contact surface against which the roller may drive the sheets. In addition, the ramp is preferably disposed at an angle so as to further reduce the level of friction the top sheet needs to overcome in moving across the ramp. In this regard, the tray may include retaining structure for holding the supply of sheets in at an angle that corresponds to the angle of the ramp so that a leading edge of each of the sheets in the tray abuts the ramp.

According to another preferred embodiment of the invention, the path that a sheet travels before engaging with another component of the imaging system, for example, a transferring unit of the imaging subsystem, is minimized to reduce the likelihood of jamming errors. In this regard, a top edge of the ramp may be disposed at or near the imaging subsystem. To maintain the relatively short distance, the imaging subsystem may be disposed within the imaging system at an angle so that one of the ends may be positioned near the top edge of the ramp.

According to another preferred embodiment of the invention, a sheet feeder for an imaging system includes a linkage and a roller. The roller is disposed on the linkage and contacts and drives a sheet from a supply of sheet material. The linkage is configured to move the roller substantially linearly as the supply of sheet material decreases, preferably along an angulated linear path. The sheet feeder may also include a ramp for directing the sheet driven from the supply of sheet material by the roller to an imaging subsystem of the imaging system. In this embodiment, the linkage may be configured to move the roller along a path that is substantially parallel to the ramp. Alternatively, the linkage may configured to maintain the substantially constant roller stroke distance between the roller and the ramp regardless of a level of the supply of sheet material. A motor may be disposed on the linkage for driving the roller.

These and other features will become apparent from the drawings and following detailed discussion, which by way of example without limitation describe preferred embodiments of the present invention.

Referring to the drawings, an imaging system 50 with a highly stable and essentially error-free sheet feeder 52 is illustrated in FIGS. 1 to 5 according to an exemplary embodiment of the present invention. The principles of the present invention are described herein in the context of an electrophotographic (EPG) imaging system illustrated in the drawings. However, the invention is equally applicable to other devices in which sheets are fed, such as printers and copiers of all types. Therefore, prior to describing the principles of the present invention in detail, an exemplary embodiment of the imaging system 50 will be briefly described to place the sheet feeder 52 in this context.

With continued reference to FIGS. 1 to 5, sheet feeder 52 includes a supply tray 80 for receiving a supply 82 of sheet material and a drive assembly 84 for engaging and driving a top sheet 86 of the supply 82 to a transfer unit along an initial portion of the sheet path S. Sheet feeder 52 may also include a ramp 88 for directing the top sheet 86 to the transfer unit of an imaging subsystem. For the purposes of this description, the term sheet is used herein to indicate any type of substrate on which an image may be formed, such as paper, transparencies, label sheets, envelopes, cards, and the like, either individual substrates (e.g., 8½ by 11 paper) or a continuous roll of substrate material.

According to a preferred embodiment, the drive assembly 84 generally includes a roller 90 and a motor disposed at an end 94 of a linkage 96. Linkage 96 is configured to allow the roller 90 to contact and rest upon the top sheet 86 regardless of the level of the supply 82 of sheets. In addition, exemplary linkage 96 is configured to maintain a substantially constant roller distance between the roller 90 and the ramp 88 so as to define a constant stroke distance d for the roller 90 to drive a top sheet 86 to the ramp 88. Stroke distance d is the distance of a singular, unbroken linear movement of the reciprocating roller 90. Further, exemplary linkage 96 is configured to maintain the constant roller distance d between the roller 90 and the ramp 88 regardless of the level of the supply 82 of sheet material.

Figure 2:
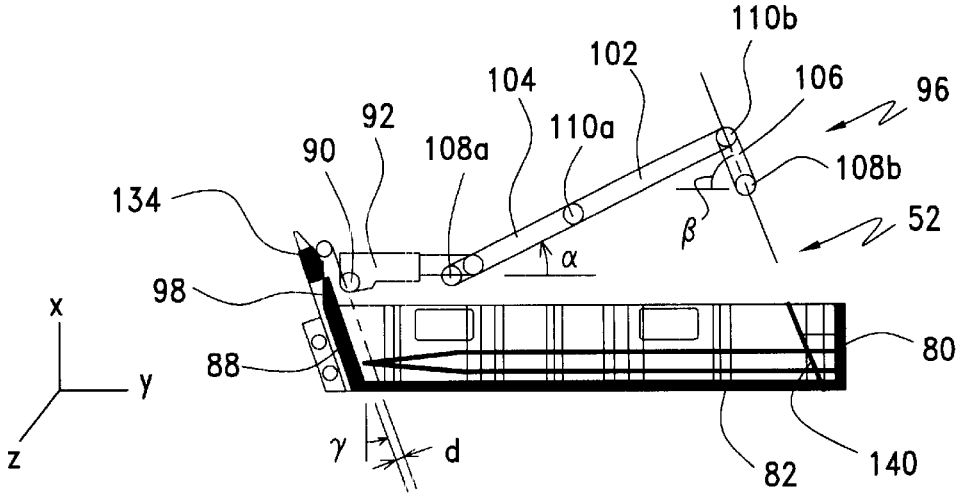
FIG. 2 is an elevational view of an exemplary sheet feeder of the present invention, particularly illustrating a linkage in an elevated position when a supply tray is full or nearly full of sheet material.
Figure 3:
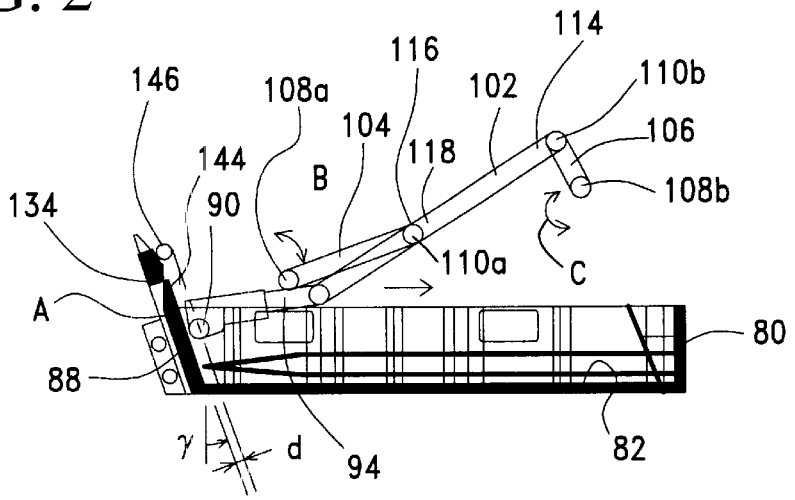
FIG. 3 is a view similar to that of FIG. 2, particularly illustrating the linkage in a position when the supply tray is less than full but not empty.
Figure 4:
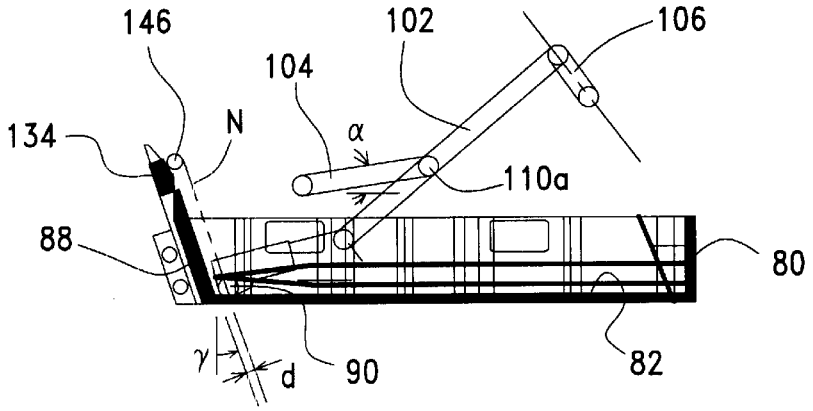
FIG. 4 is a view similar to those of FIGS. 2 and 3, particularly illustrating the linkage in a lowered position with the supply tray empty or nearly empty.

More specifically, with additional reference to FIGS. 2 to 4, the stroke distance d is defined between the roller 90 and the ramp 88. When the supply tray 80 is full or nearly full as shown in FIG. 2, the roller 90 is positioned in an upper position near an upper end 98 of the ramp 88. As the supply of sheets in the supply tray 80 decreases as shown in FIG. 3, the roller is positioned in a mid-level position. And when the supply tray 80 is nearly empty or empty as shown in FIG. 4, the roller 90 is positioned in a lower position near a lower end 100 of the ramp 88. As shown in these figures, the distance d between the roller 90 and the ramp 88 remains the same regardless of the spatial position of the roller 90.

With particular reference to FIGS. 2 to 5, linkage 96 according to a preferred embodiment includes three members: a primary member 102, a secondary member 104, and a tertiary member 106. The linkage 96 also includes a first fixed axle 108*a* and a second fixed axle 108*b* and a first free axle 110*a* and a second free axle 110*b*. The respective positions of the fixed axles 108 are fixed to a frame of the imaging system 50 and, accordingly, the ramp 88 and the supply 82 of sheet material. The free axles 110 move spatially with the members 102, 104, 106. The frame provides structural support for various components of the imaging system 50, including the fixed axles 108.

According to the preferred embodiment, the primary member 102 is connected to the free axles 110, with a pivotal end 114 thereof connected to the second free axle 110*b*. The secondary member 104 is connected to the first fixed axle 108*a* and the first free axle 110*a*. As shown in FIG. 3, the first free axle 110*a* is connected at an intersection of an end 116 of the secondary member 104 and a midportion 118 of the primary member 102. The tertiary member 106 is connected to the second fixed axle 108*b* and the second free axle 110*b*. Accordingly, the secondary member 104 is pivotal about the first fixed axle 108*a* as shown by arrow B in FIG. 3, and the tertiary member 106 is pivotal about the second fixed axle 108*b* as shown by arrow C in FIG. 3.

This exemplary connection of the members 102, 104, 106 and the axles 108 and 110 enables the linkage 96 to move the roller 90 up and down along a path parallel to the ramp 88. In other words, the linkage 96 is configured so that an axis of rotation A of the roller 90 approximates linear motion, particularly linear motion substantially parallel to the ramp 88. More specifically, as shown in FIG. 2, when the roller 90 is in an elevated position, the second member 104 is angulated between the first fixed axle 108*a* and the first free axle 110*a,* thereby defining an angle $\alpha$ from horizontal. In addition, the tertiary member 106 is angulated between the second fixed axle 108*b* and the second free axle 110*b,* thereby defining an angle $\beta$ from horizontal.

During operation as the supply of sheet material decreases, the primary member 102 is incrementally lowered into the supply tray 80, with angles $\alpha$ and $\beta$ incrementally decreasing as well. This results from the secondary member 104 rotating downwardly about the first fixed axle 108*a,* thereby urging the primary member 102 rearward as indicated by arrow R in FIG. 3. The rearward movement of the primary member 102 as the supply of sheet material decreases in the supply tray 80 is proportional to the inclination of the ramp 88. More specifically, as shown in FIG. 3, it is preferable for the ramp 80 to be inclined with respect to vertical by an angle $\gamma$. In order to maintain the constant gap or distance d with the inclined ramp 88, the primary member 102 is urged rearward in proportion to the slope or inclination of the ramp 88. To allow the linear downward movement of the primary member 102 into the supply tray 80, the tertiary member 106 rotates about the second fixed axle 108*b*.

Corresponding to the linear movement of the distal end 94 of the primary member 102, the roller 90 moves substantially linearly. This corresponding linear movement of the roller 90 is indicated in FIG. 4 by path N. For the purposes of this description, the path N is defined as a linear path, preferably an angulated linear path, that the axis of rotation A of the roller 90 follows as the supply 82 of sheet material decreases. The path N is substantially parallel to the contact surface of the ramp 88.

With further reference to FIGS. 2 to 5, the secondary member 104 includes a pair of transverse portions rotatably mounted on respective sides of the primary member 102 on the first free axle 110*a* and each rotatably mounted on a first fixed axle $\mathbf{108}a_1$ and $\mathbf{108}a_2$, respectively. The secondary member 104 may also include a transverse brace connected between the transverse portions to provide stability and rigidity. The terms transverse, longitudinal and normal as used herein, respectively correspond to the x, y, and z axes in standard Cartesian coordinates.

To further increase the stability of the linkage 96, the distal end 94 of the primary member 102 may have a transverse dimension w larger than a proximal end of the primary member 102. The larger transverse dimension w at the distal end 94 provides greater stability at the connection to a roller housing and greater stability in counteracting any torque produced by the motor. In addition, the transversely broad distal end 94 also provides an adequate platform for supporting the motor.

In addition, the midportion 118 of the primary member 102 may be tapered from the distal end 94 to the proximal end. The primary member 102 may include an axle housing projecting transversely therefrom. In addition, the primary member 102 may include one or more cross supports to provide rigidity between the midportion 118 and the axle housing. The primary member 102 may also include a vertex or discontinuity such that the distal end 94 and the midportion 118 are angled with respect to each other. This angle relationship allows the distal end 94 to be substantially horizontal when the supply tray 80 is relatively full as shown in FIG. 2 and to be slightly angled (e.g., less than 30°) when the supply tray 80 is relatively empty as shown in FIG. 5. Also shown in FIG. 6, according to a preferred embodiment, each of the transverse portions of the secondary member 104 may taper from the first free axle 110*a* to the first fixed axle 108*a*.

Referencing FIGS. 2 to 5, for a given angle γ, the distance d between the ramp 88 and the roller 90 is optimized to minimize or prevent the double feeding of paper and, accordingly, paper jams. If the distance d is too small, then a relatively large torque from the motor is needed to drive the roller 90 to engage the top sheet 86 and to urge the top sheet up the ramp 88. With large torques, there is a tendency for the roller 90 to spin (much like the wheels of a car with high torque), thereby causing the sheet material to buckle and jam. If the distance d is too large, then there is a tendency to double feed sheet material (i.e., engage and drive two or more sheets) because the coefficient of friction between the sheets and the ramp 88 may be less than the coefficient of friction between the top two sheets, thereby causing the top two sheets to feed simultaneously. In view of the foregoing, for a preferred angle γ of about 20 degrees, the distance d may be maintained in a range of about 5 millimeters (mm) and about 56 mm and more preferably in a range of about 25 mm to about 36 mm. If the angle γ is increased, then the distance d may be increased, and vice versa.

Exemplary dimensions of a linkage 96 configured for a standard supply tray 80 for holding either 8½-by-11 or A4 sheet material are shown in FIG. 5. The exemplary dimensions are given for an angle γ of about 20° and a segment 132 defined between the axis of rotation A of the roller 90 and the second free axle 110*b*. A distance $P_1$ of a segment defined between the first free axle 110*a* and the second free axle 110*b* may be about 115 mm, and a distance $P_2$ of a segment defined between the first free axle 110*a* and the axis of rotation A of the roller 90 may be about 155 mm. A distance S of the secondary member 104 defined between the first fixed axle 108*a* and the first free axle 110*a* may be about 89 mm. A distance T of the tertiary member 106 defined between the second fixed axle 108*b* and the second free axle 110*b* may be about 34 mm. In addition, a distance F in the longitudinal direction defined between the locations of the fixed axles 108 may be about 195 mm, and a offset O in the normal direction defined between the locations of the fixed axle 108 may be about 59 mm. Depending upon an angle δ of the discontinuity, a height H defined between the first free axle 110*a* and the segment 132 may be about 13 mm. The angulated linear path N of the axis of rotation A of the roller 90 is also clearly shown in FIG. 5.

Referencing FIGS. 2 to 5, the ramp 88 is fixed with respect to the housing 54. For example with additional reference to FIG. 6, the ramp 88 may be attached or integral with the housing 54 and a front 134 of the supply tray 80 may include a bay with a pair of transverse panels 138*a* and 138*b* for accommodating the ramp 88. Preferably, the bay accommodates the ramp 88 such that the supply 82 of sheets abuts or is urged against the ramp 88. In this regard, the supply tray 80 may include retaining structure that is preferably disposed within the supply tray at an angle substantially equal to the angle at which the ramp 88 is disposed (i.e., angle γ). The retaining structure is preferably adjustable so that varying sizes of sheet material may be held within the tray 80 with leading edges thereof positioned at or near the ramp 88 or more preferably, abutting the ramp 88. In addition, the retaining structure is preferably configured so that the leading edges of the sheets are collectively disposed at an angle substantially equal to that of the ramp 88.

As shown in FIGS. 3 to 5 and 8, according to a preferred embodiment the ramp 88 includes a low-friction contact surface against which the sheet material slides. The low-friction contact surface may include one or more low-friction members 142*a*, 142*b*, 142*c*, . . . , 142*n*. The low-friction members 142 are preferably planar and made from a smooth and low-friction material such as a metal alloy (e.g., stainless steel) or a composite material (e.g., ceramic or porcelain). Exemplary members 142 preferably protrude beyond a back portion 144 so that the sheet material contacts the members 142 exclusively. According to a preferred embodiment, the distance d between the ramp 88 and the roller 90 may be defined between the roller 90 and the low-friction members 142.

Referencing FIGS. 3 to 5, to minimize the likelihood of paper-feeding errors, it is preferable to configure the imaging system 50 so that a top edge of the ramp 88 is disposed at or near the imaging subsystem, particularly the transfer unit. To further minimize paper-feeding errors, with further reference to FIGS. 3 to 5, exemplary imaging system 50 may include rollers 146 for receiving and engaging the top sheet from the supply 80 of sheets as the top sheet is being driven up the ramp 88, and for providing the top sheet to the transfer unit. According to a preferred embodiment, a total distance L between the top edge of the ramp 88 and the nip of the transfer unit is less than about 5 centimeters (cm) or 6 cm. For example, a distance $l_1$ between the top edge of the ramp 88 and the rollers 146 may be about 2 cm, and a distance $l_2$ between the rollers 146 and the transfer unit 70 may be about 2 cm.

Referencing FIGS. 3 to 5, to minimize the likelihood of paper-feeding errors, it is preferable to configure the imaging system 50 so that a top edge of the ramp 88 is disposed at or near the imaging subsystem, particularly the transfer unit. To further minimize paper-feeding errors, with further reference to FIGS. 3 to 5, exemplary imaging system 50 may include rollers 146 for receiving and engaging the top sheet from the supply 82 of sheets as the top sheet is being driven up the ramp 88, and for providing the top sheet to the transfer unit. According to a preferred embodiment, a total distance L between the top edge of the ramp 88 and the nip of the transfer unit is less than about 5 centimeters (cm) or 6 cm. For example, a distance $l_1$ between the top edge of the ramp 88 and the rollers 146 may be about 2 cm, and a distance $l_2$ between the rollers 146 and the transfer unit may be about 2 cm.

Those skilled in the art will appreciate that the sheet feeder 52 may include other features to enhance user compatibility. For example, the supply tray 80 may include a handle 152 as shown in FIGS. 1 and 3 to 5 for use in removing the supply tray from the system 50. Those skilled in the art will also appreciate that the imaging subsystem may be an inkjet system, a toner jet system, a laser system, and so on, with the sheet feeder 52 operating in accordance with the principles of the present invention. If the imaging subsystem is configured to carry out an EPG process as described above, then the photoconductor 60 may be a photoreceptive belt or a drum with a photoconductive substrate.

Accordingly, sheet-feeding principles of the present invention have been exemplified by the embodiments illustrated in the drawings. These principles focus on a stable and uniform approach to feeding sheets in imaging systems. While preferred embodiments of the invention have been described, the present invention is capable of variation and modification and therefore should not be limited to the precise details of the Examples. The invention includes changes and alterations that fall within the purview of the following claims.

What is claimed is:

1. An imaging system comprising:

a tray for holding a supply of sheets;

a ramp for directing a sheet from the tray to an imaging subsystem; and a drive assembly including a roller for moving a top sheet of the supply of sheets in the tray to the ramp with a reciprocating roller stroke;

the drive assembly being configured to maintain a constant roller stroke distance between the roller and the ramp.

2. An imaging system as claimed in claim 1 wherein the drive assembly is configured to maintain the roller distance constant independent of a level of the supply of sheets in the tray.

3. An imaging system as claimed in claim 1 wherein the ramp includes a low-friction member.

4. An imaging system as claimed in claim 3 wherein the roller stroke distance is defined as the distance between the roller and the low-friction member.

5. An imaging system as claimed in claim 1 wherein the tray includes retaining structure for holding the supply of sheets in a predetermined arrangement.

6. An imaging system as claimed in claim 5 wherein the retaining structure is configured to hold the supply of sheets so that a leading edge of each of the sheets abuts the ramp.

7. An imaging system as claimed in claim 5 wherein the ramp is disposed at an angle and wherein each of the sheets has a leading edge;

the retaining structure being configured for holding the supply of sheets so that the leading edges are collectively disposed at an angle approximately equal to that of the ramp.

8. An imaging system as claimed in claim 5 wherein the ramp is disposed at an angle;

the retaining structure being disposed on the tray at an angle approximately equal to that of the ramp.

9. An imaging system as claimed in claim 1 further comprising a housing with a compartment for receiving the tray.

10. An imaging system as claimed in claim 9 wherein the ramp is disposed in a fixed relationship with the housing.

11. An imaging system as claimed in claim 1, wherein the drive assembly comprises a linkage and the system further comprises a roller disposed on the linkage for engaging a sheet moving along the ramp.

12. An imaging system as claimed in claim 1 wherein the drive assembly includes a linkage with a distal end;

the roller being disposed on the distal end of the linkage;

the linkage being configured to move the roller substantially linearly as the supply of sheet material decreases in the tray.

13. An imaging system as claimed in claim 12 wherein the linkage is configured to move the roller substantially parallel to the ramp.

14. An imaging system as claimed in claim 1, wherein the linkage comprises:

a first fixed axle and a second fixed axle, both fixed with respect to the supply of sheets and with respect to the ramp;

a first free axle and a second free axle, both free to move spacially; and a primary member connected to the free axles with a pivotal end connected to the second free axle;

a secondary member connected to the first fixed axle and the first free axle; and a tertiary member connected to the second fixed axle and to the second free axle, the drive assembly axles and members being configured to maintain a constant distance between the roller and the ramp during a respective roller stroke.

15. An imaging system as claimed in claim 14, wherein the drive assembly is configured to maintain the roller distance constant independent of a level of the supply of sheets in the tray.

16. An imaging system as claimed in claim 14, wherein the ramp includes a low-friction member.

17. An imaging system as claimed in claim 16, wherein the roller stroke distance is defined as the distance between the roller and the low-friction member.

18. An imaging system as claimed in claim 14, wherein the tray includes retaining structure for holding the supply of sheets in a predetermined arrangement.

19. An imaging system as claimed in claim 18, wherein the retaining structure is configured to hold the supply of sheets so that a leading edge of each of the sheets abuts the ramp.

20. An imaging system as claimed in claim 18, wherein the ramp is disposed at an angle and wherein each of the sheets has a leading edge;

the retaining structure being configured for holding the supply of sheets so that the leading edges are collectively disposed at an angle approximately equal to that of the ramp.

21. An imaging system as claimed in claim 18, wherein the ramp is disposed at an angle, the retaining structure being disposed on the tray at an angle approximately equal to that of the ramp.

22. An imaging system as claimed in claim 14, further comprising a housing with a compartment for receiving the tray.

23. An imaging system as claimed in claim 22, wherein the ramp is disposed in a fixed relationship within the housing.

24. An imaging system as claimed in claim 14, wherein the ramp has a top edge disposed at or near the imaging subsystem.

25. An imaging system as claimed in claim 24, further comprising a roller disposed between the ramp and the imaging subsystem for engaging a sheet moving along the ramp.

26. An imaging system as claimed in claim 14, wherein the drive assembly includes a linkage with a distal end;

the linkage being configured to move the roller substantially linearly as the supply of sheet material decreases in the tray.

27. An imaging system as claimed in claim 26, wherein the linkage is configured to move the roller substantially parallel to the ramp.

28. A sheet feeder for an imaging system, the sheet feeder comprising:

a ramp for directing a sheet from the tray to an imaging subsystem; and a linkage; and a roller disposed on the linkage for contacting and driving a sheet from a supply of sheet material by a reciprocal linear movement through a roller stroke distance;

the linkage being configured to maintain a constant roller stroke distance between the roller and the ramp.

29. A sheet feeder as claimed in claim 28 wherein the linkage is configured to move the roller along an angulated linear path.

30. A sheet feeder as claimed in claim 28 further comprising a ramp for directing the sheet driven from the supply of sheet material by the roller to an imaging subsystem of the imaging system.

31. A sheet feeder as claimed in claim 30 wherein the linkage is configured to move the roller along a path that is substantially parallel to the ramp.

32. A sheet feeder as claimed in claim 30 wherein the linkage is configured to maintain a substantially constant roller stroke distance between the roller and the ramp regardless of a level of the supply of sheet material.

33. A sheet feeder as claimed in claim 30 wherein the ramp is disposed at an angle.

34. A sheet feeder as claimed in claim 30 wherein the linkage is configured to move the roller in a path that is substantially parallel to the ramp.

35. A sheet feeder as claimed in claim 28 further comprising a tray for holding the supply of sheet material.

36. A sheet feeder as claimed in claim 28 further comprising a motor disposed on the linkage for driving the roller.

37. A method for feeding sheets in an imaging system, the method comprising:

moving a roller in a reciprocating stroke to drive a sheet from a supply of sheets to a ramp that directs the sheet to an imaging subsystem; and maintaining a constant distance for each stroke as the supply of sheets diminishes.

38. A method as claimed in claim 37 wherein the stroke distance is determined to prevent multiple sheet feeding and torque jamming for a particular sheet size and material.

39. A method as claimed in claim 37, further comprising maintaining a constant linear stroke of the roller stroke as the supply of sheet material decreases.

* * * * *